US011613416B2

(12) United States Patent
Schmid

(10) Patent No.: US 11,613,416 B2
(45) Date of Patent: Mar. 28, 2023

(54) CONTAINER CLOSURE WITH STANDARD CAPSULE

(71) Applicant: MONTFORT SOLUTIONS GMBH, Koblach (AT)

(72) Inventor: Martin Schmid, Sulz (AU)

(73) Assignee: MONTFORT SOLUTIONS GMBH, Koblach (AT)

( * ) Notice: Subject to any disclaimer, the term of this patent is extended or adjusted under 35 U.S.C. 154(b) by 519 days.

(21) Appl. No.: 16/619,572

(22) PCT Filed: Jul. 16, 2018

(86) PCT No.: PCT/EP2018/069302
§ 371 (c)(1),
(2) Date: Jan. 10, 2020

(87) PCT Pub. No.: WO2019/012156
PCT Pub. Date: Jan. 17, 2019

(65) Prior Publication Data

US 2020/0140162 A1 May 7, 2020

(30) Foreign Application Priority Data

Jul. 14, 2017 (DE) ..... 102017115934.7

(51) Int. Cl.
*B65D 51/28* (2006.01)
*B65D 47/24* (2006.01)
*B65D 85/804* (2006.01)

(52) U.S. Cl.
CPC ..... *B65D 51/2821* (2013.01); *B65D 47/247* (2013.01); *B65D 85/8043* (2013.01)

(58) Field of Classification Search
CPC ..... B65D 25/085; B65D 25/087; B65D 51/2814; B65D 51/2835; B65D 51/285;
(Continued)

(56) References Cited

U.S. PATENT DOCUMENTS 4,884,705 A 12/1989 Debetencourt
6,305,576 B1 * 10/2001 Leoncavallo ..... B65D 51/2814 222/88
(Continued)

FOREIGN PATENT DOCUMENTS

CH 700312 A 7/2010

*Primary Examiner* — King M Chu
(74) *Attorney, Agent, or Firm* — Andrew Wilford

(57) ABSTRACT

Container closure for a container (1), the container closure having at least one receiving chamber, for receiving a substance of liquid or powdery consistency, and having a mouthpiece (5) comprising a through-opening (13), characterized in that the container closure has an adapter (2), into which a capsule (3) having the substance is interchangeably inserted, and an actuating element (6) for actuating the capsule (3), wherein the capsule (3) has a housing forming the receiving chamber, in which a perforator (7) is arranged, and the housing has two openings, wherein one opening is closed by a closure film (8) and the second opening is closed by an end region of the perforator (7), wherein the actuating element (6) is operatively connected to the end region of the perforator (7) that closes the second opening of the capsule (3), and the adapter (2), the capsule (3) and the actuating element (6) form mutually separate components.

10 Claims, 6 Drawing Sheets

(58) Field of Classification Search
CPC ..... B65D 51/2807; B65D 51/28; B65D 81/3266
USPC ..... 206/219, 222; 215/250
See application file for complete search history.

(56) References Cited

U.S. PATENT DOCUMENTS

| | | | | |
|---|---|---|---|---|
| 8,925,769 | B2 | 1/2015 | Zapp | |
| 8,960,424 | B1 | 2/2015 | Anderson | |
| 9,242,772 | B1 | 1/2016 | Anderson | |
| 9,533,870 | B2 | 1/2017 | Zapp | |
| 9,821,997 | B2 | 11/2017 | Zapp | |
| 2008/0067172 | A1 | 3/2008 | Wilhelm | |
| 2017/0107030 | A1* | 4/2017 | Presche | B65D 51/2835 |

* cited by examiner

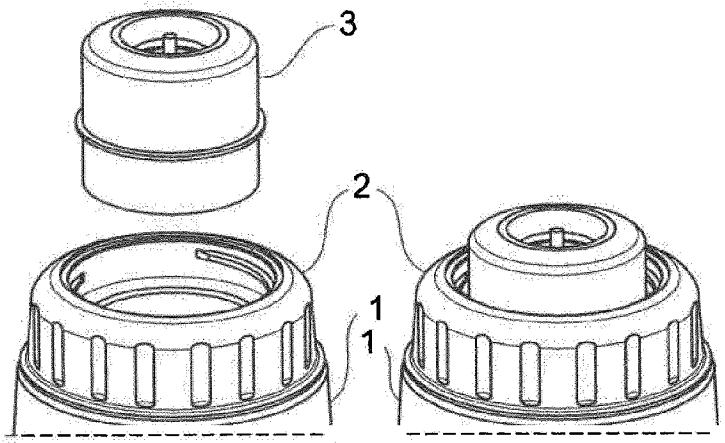
Fig. 3A
Fig. 3B
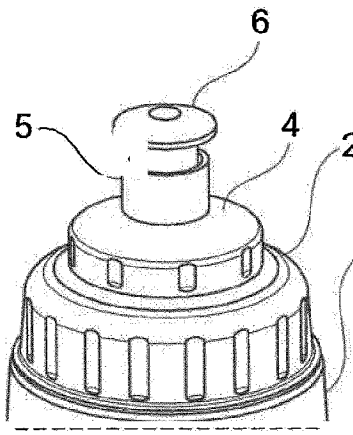
Fig. 3C
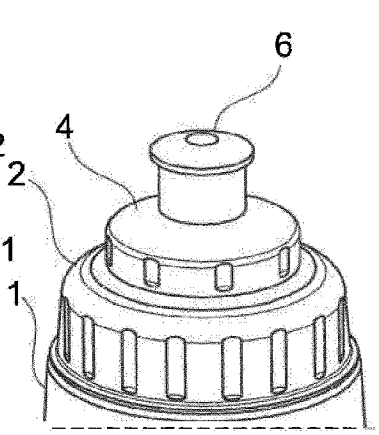
Fig. 3D
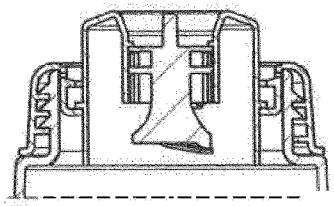
Fig. 3E
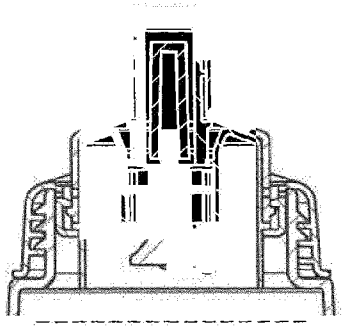
Fig. 3F
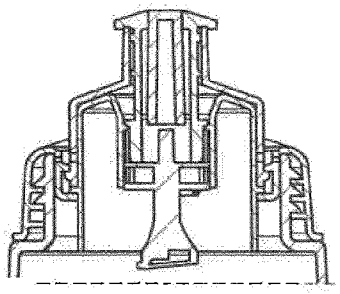
Fig. 3G

CONTAINER CLOSURE WITH STANDARD CAPSULE

CROSS REFERENCE TO RELATED APPLICATIONS

This application is the US-national stage of PCT application PCT/EP2018/069302 filed 16 Jul. 2018 and claiming the priority of German patent application 102017115934.7 itself filed 14 Jul. 2017.

FIELD OF THE INVENTION

The invention relates to a container closure for a container, wherein the container closure at least has a compartment for receiving a substance of liquid or powdery consistency, and a mouthpiece having a passage, and a capsule into which a medium, preferably a powder, is poured and is sealed off from the outside, as per the features in the respective preambles of the independent claims.

WO 2006/099768 [US 2008/0067172] discloses a container closure for a container, for example a bottle, having what is known as a push-pull closure. The container closure has a cover part that is able to be fitted around a container opening and has a sealing lip, and a pushing part that is movable attached to the cover part, and an outflow opening is openable or closable by sliding the sliding part on the cover part.

Attached to the sealing lip is a closure film that is able to be torn open or perforated, with the result that an additional space that is partitioned off in a sealed manner from the container contents is formed in the interior, facing the sliding part, of the cover part. Furthermore, a movable spike having a tear-open and perforation device is fitted in the cover part, wherein, by actuating the spike, the closure film is torn open or perforated and as a result a substance that is introducible into the additional space can pass into the container, wherein the additional space of the container closure is configured in a sealed manner for storing a substance of liquid or powdery consistency.

The structure of that closure is extremely complicated and complex and cannot be recycled after it has been used. All functional elements, such as the connection to the bottle, the mouthpiece, and the compartment with the perforator are present in a single component. On account of the complicated structure, a very large amount of waste material arises after the closure has been used.

Furthermore, on account of the design of the cover part, the container closure forms the connection to the container, such that, for every design of a container, in particular for every diameter of the container, onto which the container closure is placed or screwed, a container closure matched specifically thereto has to be provided.

OBJECT OF THE INVENTION

The invention is based on the object of improving a container closure such that it is universally usable and such that the accrual of waste material is considerably reduced.

SUMMARY OF THE INVENTION

This object is achieved by a container that is provided with an adapter. The adapter allows a capsule having a medium, for example a powder, to be fitted in the region of the opening of the container, on which the adapter is located.

Furthermore, after the capsule has been fitted in the adapter, a closure means, in particular a cap having an integrated mouthpiece can be put on.

Therefore, in other words, according to the invention, the container closure has an adapter, into which a capsule holding the substance is inserted in an exchangeable manner, and an actuating element for actuating the capsule, wherein the capsule has a housing forming the compartment, in which a perforator is arranged, and the housing has two openings, wherein one opening is closed by a closure film and the second opening is closed by an end region of the perforator, wherein the actuating element is operatively connected to the end region, closing the second opening of the capsule, of the perforator, and the adapter, the capsule, and the actuating element form mutually separate components.

The considerable reduction in waste material is brought about by the fact that only the capsule, in which the medium is located and the closure of which can be perforated by a spike in order to access the container, has to be disposed of after this operation. The remaining parts that form the container closure (namely the adapter and the cap with the integrated mouthpiece, just like the bottle) can be recycled. Preferably, the capsule is in the form of a standard capsule and can cooperate with all different adapters and/or different closure means. Furthermore, the capsule, in particular the standard capsule, has the advantage that it can be collected and recycled. Ideally, therefore, no waste material accrues anymore. If, for any reason, it were to be impossible to recycle the capsule, much less waste material nevertheless accrues than is the case according to the prior art.

In contrast to the prior art described at the beginning (in which the entire container closure accrues as waste material after it has been used), according to the invention only a capsule of geometrically simple design has to be disposed of or recycled, while the remaining elements that form the container closure can be used further.

In the simplest case, the adapter of the container is a form fit between the internal geometry of the opening of the container and the external geometry of the capsule, with which it is inserted into the opening. It is also conceivable to configure the adapter as a separate part. In this case, it can be adapted to the geometry that is present in the region of the opening of the container, for example a thread geometry or a bayonet. In addition, it is adapted to the external geometry of the capsule, such that the capsule can be on the adapter in a force-fitting or form-fitting manner for example likewise by a screwing operation or a type of bayonet, and secured in a sealing manner.

The same goes for the connection between the capsule and the cap with or without an integrated mouthpiece.

In one particular embodiment, the outside diameter of the capsule is chosen such that it is virtually the same size as the inside diameter of the opening of the container. In this case, the capsule can be inserted directly into this opening without any adaptation of the diameter being necessary. In this embodiment, the adapter does not serve for adaptation to different diameters but forms a cap that is on the opening of the container, for example can be screwed on. The actuating element (in particular the perforator) is either a constituent only of the adapter or only of the capsule or is formed by a constituent of the adapter and of the capsule. If the actuating element is only a constituent of the capsule, it is protected from accidental actuation by the adapter (equal to the cap). Thus, the actuating element can only be actuated deliberately when the adapter has been removed from the opening of the container, for example has been unscrewed. It is also conceivable for the actuating element of the capsule to be able to be actuated when the adapter is on the container, in particular has been screwed on. The capsule can, but does not have to be, secured to the container in a releasable manner by a sealing element, in particular a fully encircling sealing element, with the opening of the container (to be more precise to the encircling rim of the opening of the container) by the adapter. In this embodiment, too, it is possible to remove the capsule after it has been emptied and to replace it with a new capsule without the other elements of the container closure having to be replaced. In this embodiment, the adapter thus serves at the same time as a cap, such that, it secures either the capsule in the opening of the container (and is optionally protected from accidental actuation of the actuating element) or closes the opening of the container without an inserted capsule.

In a development of the invention, the container closure has a cap that is operatively connected to the adapter and into which the mouthpiece and the actuating element that is movable, are integrated. The cap covers the container closure and connects it to the adapter for example by being screwed on, pressed on, by a flap connection (for example a film hinge) or the like. Moreover, the mouthpiece can, but does not have to be, integrated into the cap, meaning that the mouthpiece is an integral constituent of the cap. This has the advantage that the cap can be produced together with the mouthpiece, for example in a plastic injection-molding process.

In a development of the invention, the mouthpiece, the actuating element and the perforator are coaxial. This provides a design variant for configuring the design of the container closure when it is attached to the container. Furthermore, this centered arrangement of the mouthpiece on the central vertical axis of the container and thus also of the cap is highly suitable for drinking the liquid once the basic liquid has been introduced into the container and the substance in the capsule has passed from the latter into the liquid by actuation of the actuating element and has mixed therewith.

In a development of the invention, the actuating element movable in the mouthpiece forms a closure for the passage. Via the passage in the mouthpiece, the liquid present in the container can be removed, preferably drunk. Since, as a rule, not the entire volume is removed, the actuating element movable in the mouthpiece forms a closure for the passage. As a result, what is known as a push-pull closure is realized. This can be actuated as often as required for removing, in particular drinking, the liquid in the container.

In a development of the invention, the actuating element and the perforator are coaxial and the mouthpiece is on a different axis. This results in a further variant as regards design aspects for arranging the mouthpiece on a vertical axis that differs from the axis on which the actuating element and the perforator are arranged. As a result, it is possible for example for the mouthpiece to be at the rim of the cap, while the capsule and the actuating element that actuates the capsule are concentrically about the central vertical axis of the container and thus also of the cap. The arrangement of the mouthpiece at the rim of the cap, i.e. in the outer circumferential region thereof, also has the advantage that the closure for closing and opening the passage in the mouthpiece can be actuated independently of one another by the actuating element, with which the perforator in the capsule is actuated. If the cap is in two parts (a lower part with which it is connected to the adapter and an upper part that is movable, in particular pivotal away therefrom), the ergonomics of actuating the cap (in particular the upper part thereof) and the removal of the liquid via the mouthpiece can be noticeably improved. In such a case, the flap mechanism (for example a film hinge) is on the diametrically opposite side of the cap in which the mouthpiece is located.

In a development of the invention, the actuating element is an integral constituent of the cap. As a result, the cap can be produced very effectively together with the actuating element. Independently of whether the cap is formed in one piece or in a multipart manner (preferably lower part and upper part in which the mouthpiece is integrated, or optionally further parts), a unitary cap with the actuating element (and optionally also the mouthpiece) can be produced and handled. The actuating element is integrated for example in the cap (preferably the upper part thereof, more preferably on the central vertical axis of the cap and thus also of the container or around said axis) by the region of the cap which is pressed to actuate the perforator being embodied with a smaller wall thickness than the surrounding region. Alternatively or in addition, the actuating element can be produced together with the cap in a two-component plastic injection-molding process. To this end, the cap and the actuating element are formed from two different plastics with different hardnesses. The plastics material of the cap is thus harder than the material that forms the region that, for its part, forms the actuating element for the perforator of the inserted and exchangeable capsule.

In a development of the invention, in addition to the actuating element for actuating the perforator, a closure element for the passage in the mouthpiece is provided. As a result, both the elements for actuating the perforator of the capsules (namely the actuating element that is integrated in the cap) and the closure element with which the passage in the mouthpiece is closed and opened, are available independently of one another. This configuration is employed when the vertical axis of the passage in the mouthpiece from the vertical axis on which or around which the actuating element and also the vertical axis of the perforator are located.

In a development of the invention, an intermediate fitting is provided that receives the capsule and is operatively connected to the adapter. The intermediate fitting adapts the geometry of the capsule, in particular the outside diameter thereof, advantageously to the opening of the container and/or (preferably) the inside diameter of the cap, in particular a lower part of the cap, and/or the inside diameter of the adapter. Particularly preferably, this intermediate fitting adapts the outside diameter of the capsule to the inside diameter of the adapter. In order to seal the connection between the capsule and the cap and/or the adapter and to prevent liquid from passing out of the container either before or after being mixed with the substance, a sealing element is provided.

In a development of the invention, the intermediate fitting has at least one passage, preferably a plurality of passages. This one passage, preferably this plurality of passages, is/are necessary when the actuating element for the perforator of the capsule and the passage in the mouthpiece or the mouthpiece itself are not on the same axis but on different ones. In this case, it is necessary to ensure that the capsule is on the adapter and on the cap, optionally with interposition of the intermediate fitting, and fixed in its position in the container closure. However, this would have the result that, following actuation of the perforator and the escape of the substance from the compartment of the capsule into the container and the subsequent mixing, the mixed liquid cannot be removed via passage in the mouthpiece in the peripheral region of the cap. To this end, it is necessary for passages to be present via which the liquid can pass out of the container in the direction of the upper region in the cap and via the passage in the mouthpiece. In order to remove the liquid (or a powder or a gel or the like), three variants are thus available:

Either the liquid is removed only through the capsule (i.e. flows through the capsule for example during a drinking or pouring operation) or only via the passages. In the latter case, there is no flow at all through the capsule for example during a drinking or pouring operation. The substance present in the capsule mixes only with the liquid in the container once the closure film has been perforated by the perforator (i.e. the capsule has been opened). Ideally, both are the case, thereby allowing complete emptying in particular of the inner volume of the capsule.

The invention therefore relates generally to a closure system for a container, in particular a bottle, wherein the closure system receives an adapter, wherein a standard capsule that contains a medium, can be inserted into the adapter, wherein the capsule is closed with a closure means, in particular a cap with an integrated mouthpiece, and a spike in the capsule is actuated by the closure means, with the result that a closure film on the capsule is perforated by the spike.

BRIEF DESCRIPTION OF THE INVENTION

In the following text, the invention is explained on the basis of an embodiment and the employment of the independent capsule according to the invention, and is described with reference to the figures in which:

FIGS. 3A and 3B show the capsule and adapter before and after being fitted together, FIGS. 3C and 3D show the assembled closure with the actuator in the unactuated and actuated positions, and FIGS. 3E-3G are sectional views corresponding to FIGS. 3B-3D;

Figure 2:
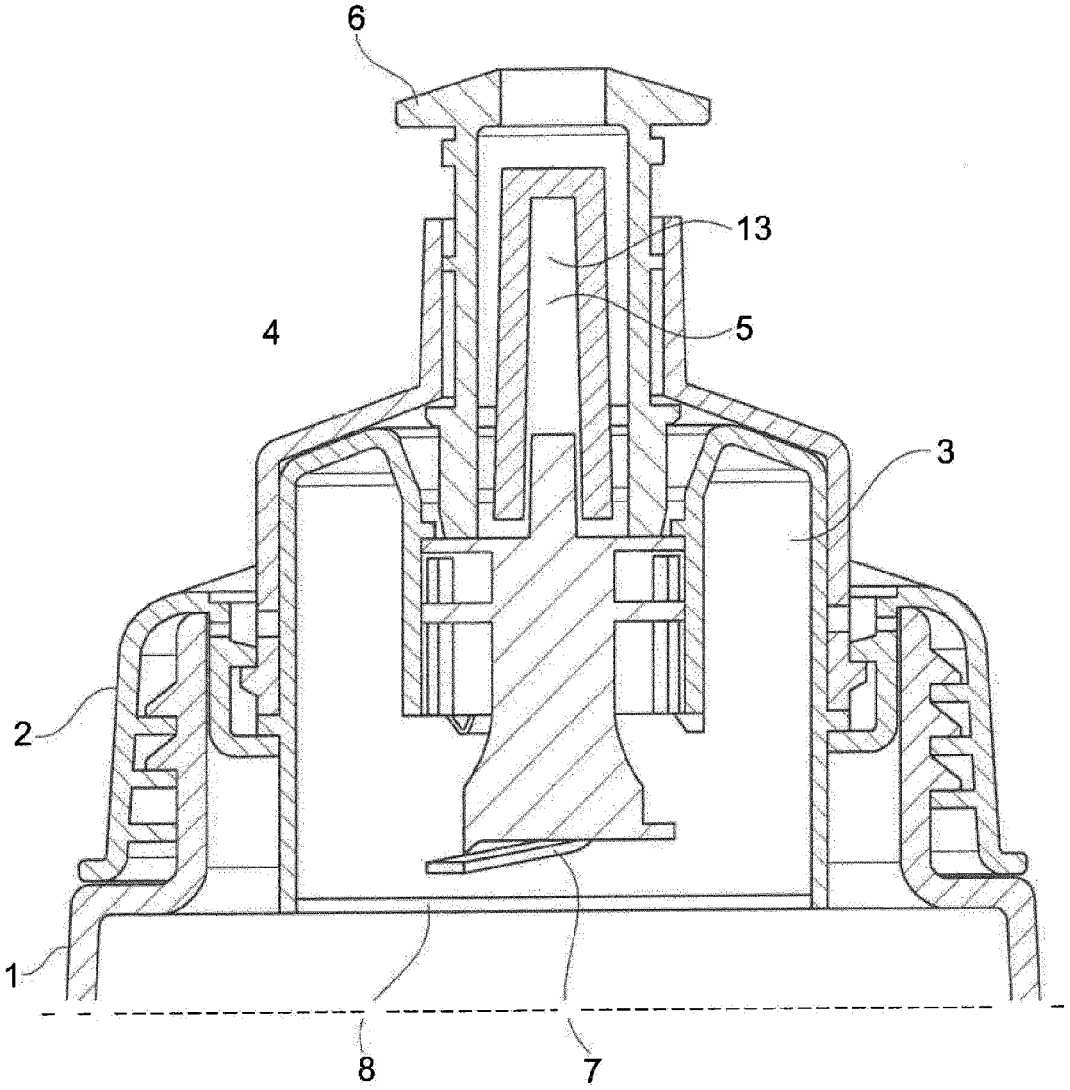
FIG. 2 is a large-scale axial section through the closure with the actuator not actuated.
Figure 4C:
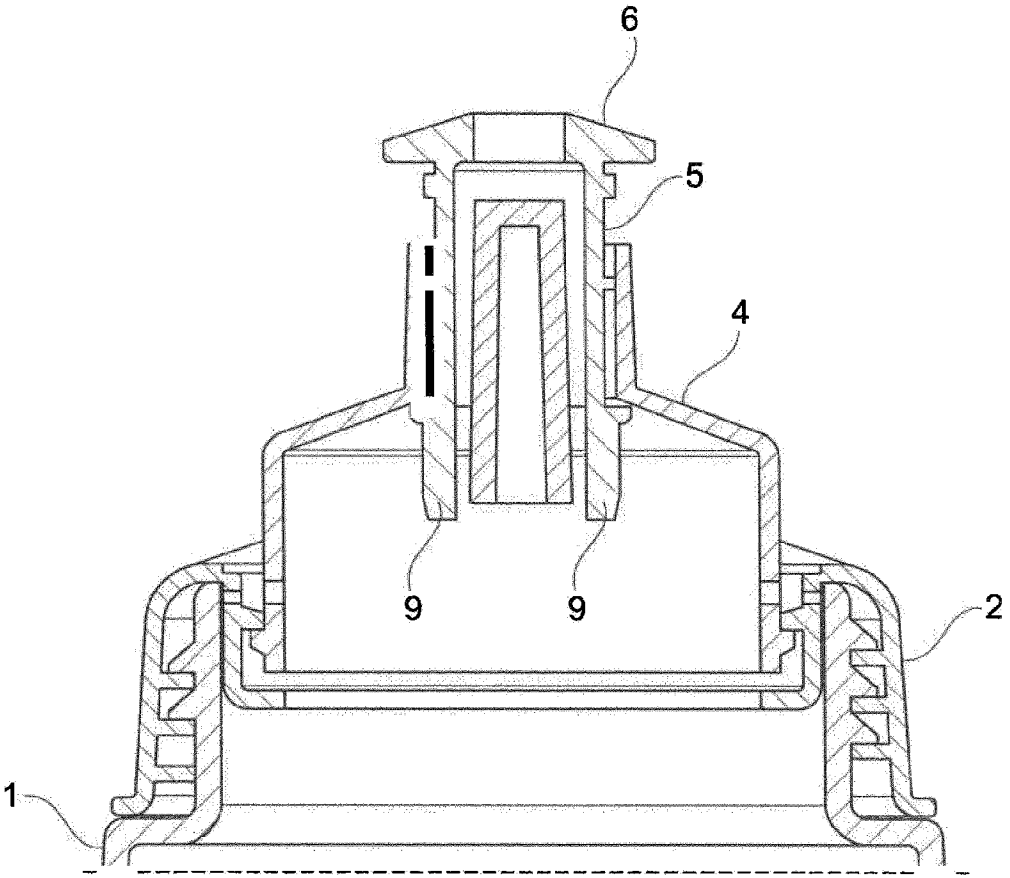
Figure 4A:
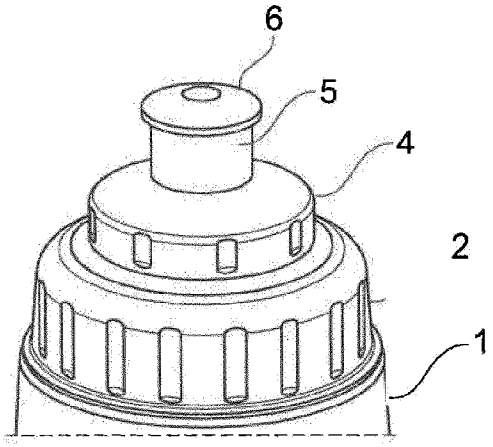
Figure 4B:
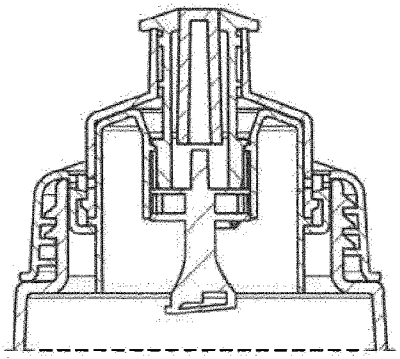
Figure 5:
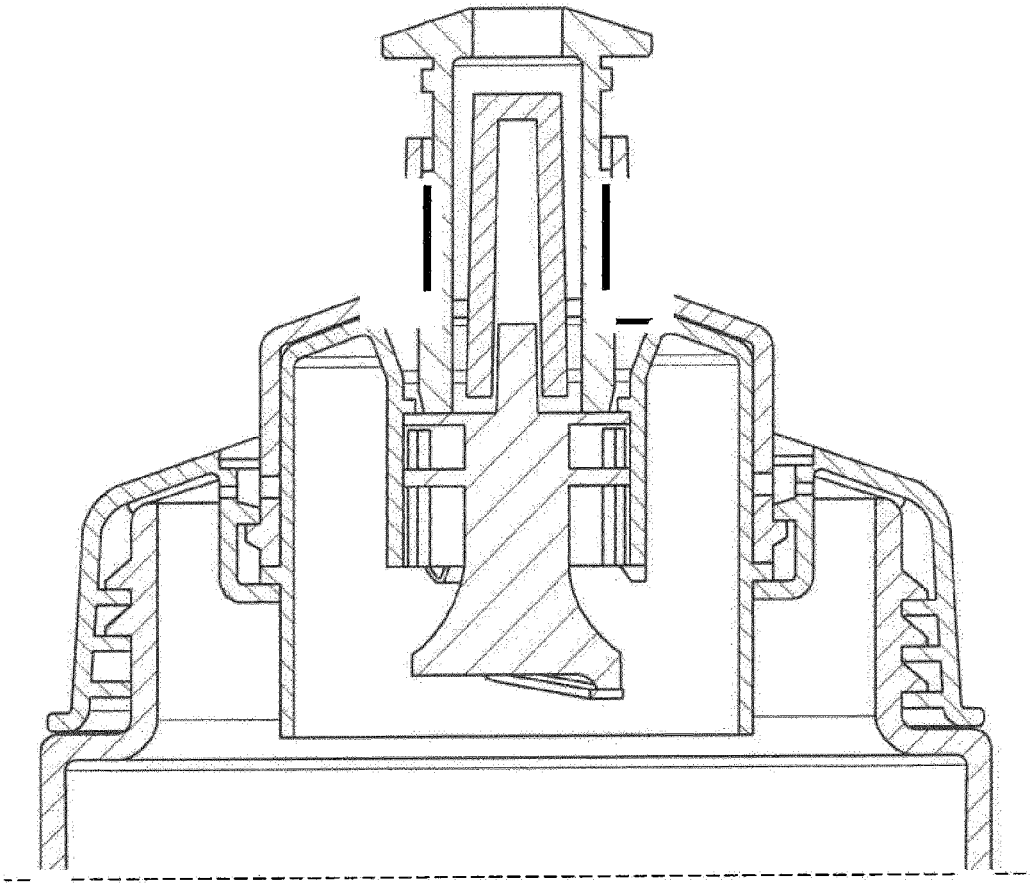

FIG. 4A-C show the closure in a small-scale perspective view, small-scale axially sectional view, and large-scale axially sectional view;

FIG. 5 is another large-scale sectional view like FIG. 2; and

Figure 6:
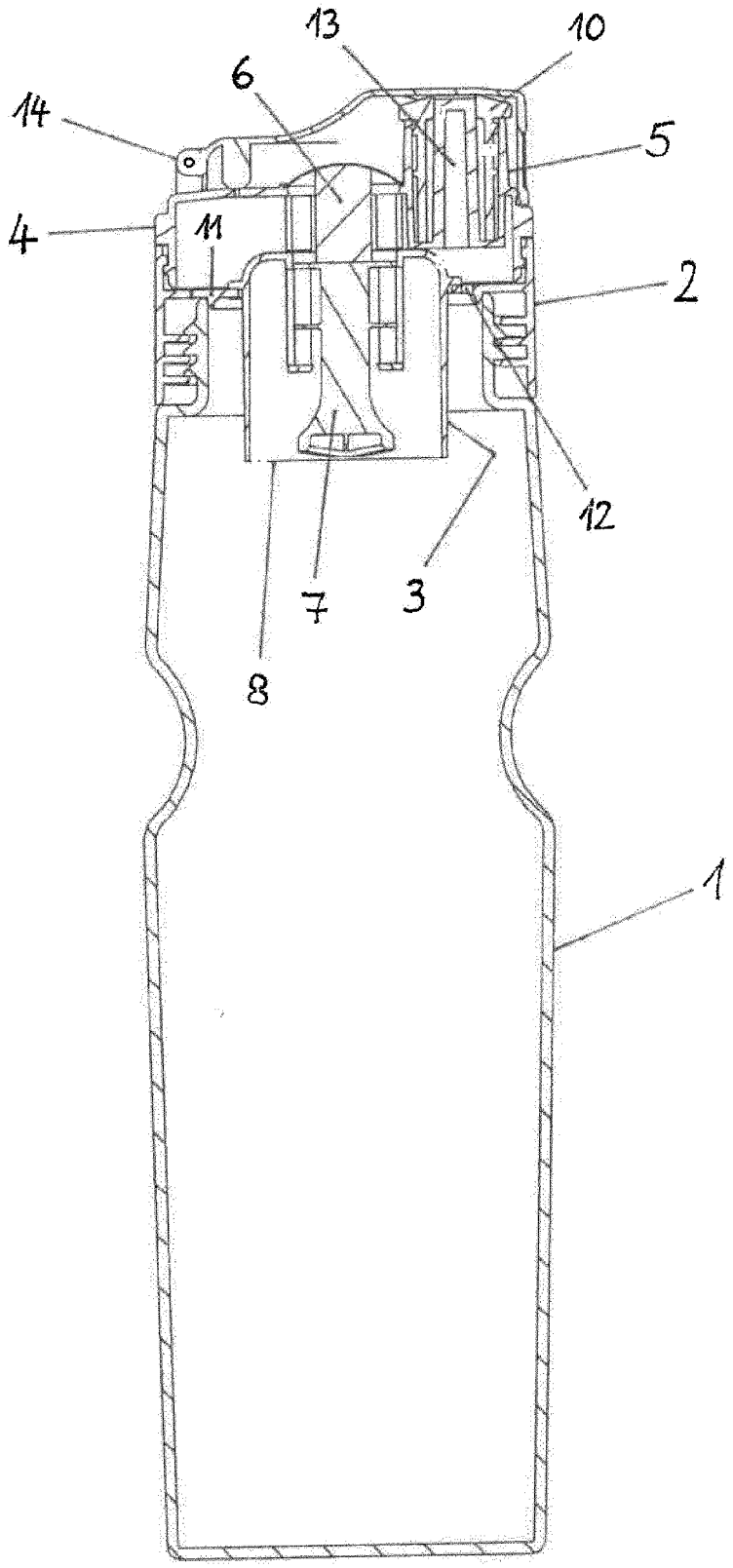

FIG. 6 is a small-scale axial section through the container and its closure.

SPECIFIC DESCRIPTION OF THE INVENTION

Figure 1:
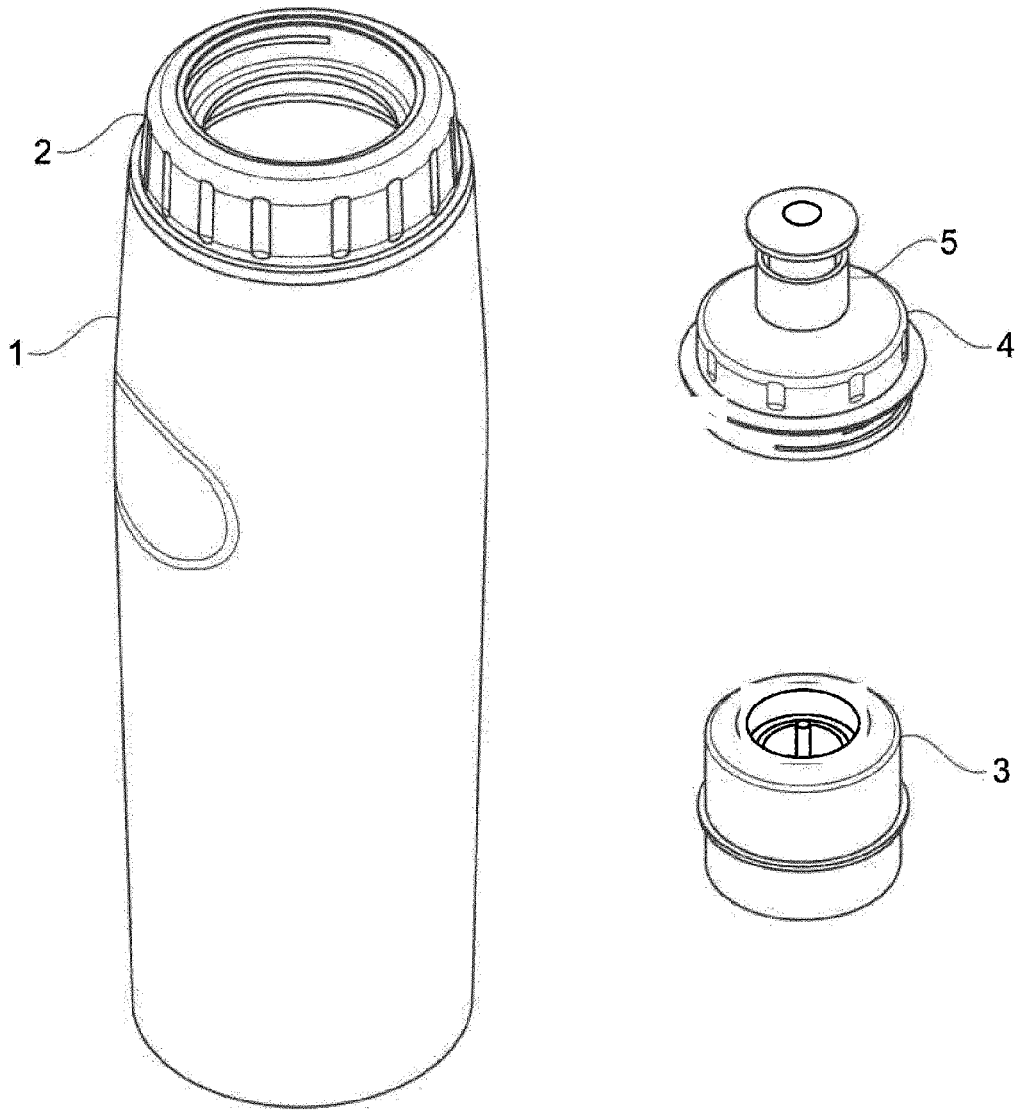
FIG. 1 is an exploded perspective view of the container with the container and the adapter on the left, the capsule in the middle, and the cap 4 mouthpiece on the right.

FIG. 1 shows, as container 1, a bottle, for example a plastics bottle. Present at the upper end thereof is an opening, into which a liquid can be poured. Also provided in this region is an adapter 2. Separately therefrom, there is a capsule 3 that is filled with a medium, for example a powder. The medium is completely closed by the capsule 3 and a closure film (not illustrated) a part of a spike (also known as perforator). It can pass into the bottle (as explained in more detail below) only as a result of a movement of the spike. Also present is a closure means, for example a cap 4 with or without an integrated mouthpiece 5. It is also conceivable to omit the cap and to arrange the spike (also known as perforator) in the capsule 3 such that it is accessible from the outside and the closure film can be perforated by actuation. Ideally, the adapter 2 and/or the closure means is formed in the region of the receptacle for the capsule 3 for receiving a standard capsule.

FIG. 2 shows a sectional view of the elements of FIG. 1 that are on the bottle (generally the container 1). It is apparent that the capsule 3 is secured to the bottle by the adapter 2. Furthermore, the cap 4 with the mouthpiece 5 is placed on this arrangement. The cap 4 with the mouthpiece 5 realizes a valve, in order to prevent actuation of the spike by the valve before use. Furthermore, an actuating element 6 is shown that is in a displaceable manner in and/or around the mouthpiece 5. The actuating element 6 acts on the perforator within the capsule 3 when it has been actuated (pushed down).

In FIGS. 3A-G, the function of the container closure according to the invention is illustrated. Once the bottle has been provided with the adapter 2, the capsule 3 is inserted into the adapter 2 (FIGS. 3A, 3B, & 3E). Subsequently, the cap 4 with the mouthpiece 5 (valve) is put on (FIGS. 3C, 3D, 3F, & 3G). This represents the situation before use. If the medium located in the capsule 3 is intended to pass into the bottle, by pushing the valve, the spike is displaced linearly and the closure film of the capsule 3 is perforated. In this way, the medium can pass into the bottle.

Following this activation, the medium thus passes out of the capsule 3 into the medium in the bottle (for example water) and can blend therewith. The through-flow of the medium in the capsule 3 in the direction of the contents of the bottle takes place via several paths such that all of the medium in the capsule 3 passes into the bottle and thus the capsule 3 is completely emptied. Once blending has taken place, it is possible, via the mouthpiece 5, for the liquid located in the bottle to be emptied out through the adapter 2, the capsule 3 and the mouthpiece 5, for example drunk.

FIGS. 4A-C shows further applications. It is conceivable for the cap 4, with inserted valve, to be put on the capsule 3 that has been inserted into the adapter 2 and in the process for the capsule 3 to be directly activated, i.e. for the spike to be actuated directly and the closure film to be perforated thereby. This is shown in FIGS. 4A and 4B. The right-hand illustration in FIG. 4 shows that the bottle closure system can also be used without a capsule. A coupling element 9 is also apparent. It for example annularly surrounds the lower end of the actuating element 6. It can also be in the form of a protrusion or of a plurality of pin-like protrusions. The actuating element 6 acts on the upper end of the perforator that closes an upper opening of the capsule 3. This upper end region of the perforator is formed for example in a plate-like manner or with an encircling lowered rim. The at least one protrusion of the coupling element 9 acts on this end region of the perforator.

FIG. 5 shows the application in which the adapter 2 is used to adapt one and the same capsule 3 (standard capsule) to different bottles by the adapter 2. If a bottle for example with a relatively large thread is intended to be used, all that is necessary is for a corresponding adapter 2 to be inserted. The remaining components of the system fit as before. This is a very significant advantage compared with the known container closure, since the latter is always adapted to a particular thread of the bottle. According to the invention, a standard capsule that can be used for all bottles, can be employed, wherein only the adapter 2 adapts to different container openings and closure systems.

FIG. 6, in contrast to FIGS. 1 to 5, shows a further embodiment of the invention. In this embodiment, too, a container 1 is provided, on which an adapter 2 is placed, preferably screwed on. The adapter 2 receives the capsule 3, wherein the capsule 3 and the adapter 2 are covered by a cap 4. The cap 4 is operatively connected to the adapter 2, for example again by screwing together, although pressing on, catching or the like is also conceivable.

In its upper outer circumferential peripheral region, the cap 4 has the mouthpiece 5. Thus, the longitudinal axis of the mouthpiece 5 is on an axis that differs from the vertical axis, in particular the central vertical axis, of the container 1. However, on this central vertical axis of the container 1, the actuating element 6 and thus also (not illustrated) the longitudinal axis of the perforator 7 is on an axis that differs from the container 1. However, on this central vertical axis of the container 1, the actuating element 6 and thus also (not illustrated) the longitudinal axis of the perforator 7 are arranged. In this case, the actuating element 6 is a constituent of the cap 4 and can be a separate component in the cap 4 (for example by being pressed in or catching). Alternatively, it can be produced together with the cap 4 in a two-component plastic injection-molding process. In this embodiment, too, the closure film 8 is again apparent.

In this case, the mouthpiece 5 has a separate closure element 10, with which a passage 13 of the mouthpiece 5 can be closed and opened in order for it to be possible to remove the contents of the container 1 in the opened state and, in the closed state, to prevent the contents from passing out (what is known as the push-pull principle). Of course, the mouthpiece 5 with its elements can also be designed in some other way.

In this embodiment, the central capsule 3 is kept in its position on the adapter 2, in particular on the upper edge of the adapter 2, and on the cap 4, in particular on a downwardly directed end of an encircling inner rib of the cap 4, using an intermediate fitting 11, in particular an annularly symmetrically designed element. The adapter 2, the cap 4, and the intermediate fitting 11 form independent individual elements that are produced separately from one another. Using a sealing element (which can optionally be dispensed with), a sealing connection is produced between the intermediate fitting 11, in particular an outwardly directed encircling rib of the intermediate fitting 11, and the cap 4, in particular a downwardly directed edge of the inner encircling rib of the cap 4, and the upwardly encircling edge of the adapter 2. As a result of this design that is very readily apparent in FIG. 6, the region that beneath the plane in which the outwardly directed rib of the intermediate fitting 11 is located, is sealed off. In principle, an overflow of liquid that is located beneath this plane in the lower region of the cap 4 or of the container 1 into the region of the cap 4 that is located thereabove, in particular in the direction of the mouthpiece 5, would not be possible. However, this is enabled by passages 12 that are in the intermediate fitting 11. Such passages can be provided only in the intermediate fitting 11. Alternatively or in addition, it is conceivable to provide such passages in the rim around the container opening and/or in the cap 4 and/or in the adapter 2. In this case, care should be taken in any case to ensure that no liquid can escape to the outside (out of the container 1 and out of the container closure), but at the same time to ensure that the liquid contained in the container 1 can be removed from the capsule 3 via the passage 13 in the mouthpiece 5 after said liquid has been mixed with the substance. These passages 12 can be dispensed with when the mixed liquid is removed only through the capsule 3. Otherwise, the above description also applies for the case in which liquid is intended to be poured into the container via the passage 13 and a capsule 3 that has not yet been emptied, is inserted. Then, the liquid can be poured into the interior of the container 1 via the mouthpiece 5 and the passages 12. If these passages 12 are not present, it is necessary to insert the capsule 3 only when liquid has been introduced into the container 1. Otherwise, in the simplest case, the adapter 2 with its cap 4 is unscrewed and liquid introduced into the container 1 as long as a capsule 3 has not yet been inserted. Only when the liquid has been poured into the container 1 is the adapter 2 screwed on to the upper rim of the opening of the container 1, and is the capsule 3 inserted and fixed in its position by the cap 4.

In the embodiment according to FIG. 6, the cap 4 is in two parts. The lower part of the cap 4 is operatively connected to the adapter 2, while the upper part of the cap 4 can be flapped open and closed about a hinge 13. In the flapped closed state according to FIG. 6, the actuating element 6 is protected against being actuated unintentionally. Moreover, the closure element 10 of the mouthpiece 5 is fixed in its position. The closure element 10 can thus only be actuated and thus the passage 13 opened up when the upper part of the cap 4 has been flapped open.

In one embodiment, it is particularly important that, after the closure film 8 has been perforated by the perforator 7, after the actuating element 6 has been actuated, in particular pushed, the substance located in the capsule 3 mixes with the liquid (or comparable substances) located in the container 1. Once mixed, the mixed liquid can only pass out and be removed, in particular drunk, via the passages 12 in the intermediate fitting 11 (and optionally further passages in the adapter 2 and/or cap 4) and the passage 13 in the mouthpiece 5. Specific flow through the interior of the capsule 3 for removing the liquid in the container 1 does not occur in this particular embodiment. It is merely conceivable for liquid to pass into the interior of the capsule 3 after the closure film 8 has been perforated, and the container 1 is shaken. Specific flow of liquid through the interior of the capsule 3 in the direction of the passage 13 in the mouthpiece 5 does not occur in this case.

The invention claimed is:

1. A container closure comprising:

a housing forming a compartment adapted to hold a of liquid or powdery substance;

a mouthpiece having a passage;

an adapter;

a capsule holding the substance and releasably held in the adapter;

a movable actuating element for actuating the capsule, a perforator in the housing, the housing having a first opening closed by a closure film and a second opening closed by an end region of the perforator, the actuating element being operatively connected to the end region and closing the second opening of the capsule of the perforator, the adapter, the capsule, and the actuating element forming mutually separate components, and a cap operatively connected to the adapter and into which the mouthpiece and the actuating element are integrated.

2. The container closure according to claim 1, wherein the mouthpiece, the actuating element and the perforator are coaxial.

3. The container closure according to claim 1, wherein the actuating element and the perforator are coaxial and the mouthpiece is on a different axis.

4. The container closure according to claim 1, wherein the actuating element is an integral constituent of the cap.

5. The container closure according to claim 4, further comprising, in addition to the actuating element for actuating the perforator, a closure element for the passage in the mouthpiece.

6. The container closure according to claim 1, wherein the cap and the actuating element are formed from two different plastics with different hardnesses.

7. A capsule for use in a container closure according to claim 1.

8. A container closure comprising:

a housing forming a compartment adapted to hold a liquid or powdery substance;

a mouthpiece having a passage;

an adapter;

a capsule holding the substance and releasably held in the adapter;

an actuating element movable in the mouthpiece, forming a closure for the passage, and serving for actuating the capsule, and a perforator in the housing coaxial with the mouthpiece and with the actuating element, the housing having a first opening closed by a closure film and a second opening closed by an end region of the perforator, the actuating element being operatively connected to the end region and closing the second opening of the capsule of the perforator, the adapter, the capsule, and the actuating element forming mutually separate components.

9. The container closure according to claim 1, further comprising:

A container closure comprising:

a housing forming a compartment adapted to hold a liquid or powdery substance;

a mouthpiece having a passage;

an adapter;

a capsule holding the substance and releasably held in the adapter;

an actuating element for actuating the capsule, and a perforator in the housing, the housing having a first opening closed by a closure film and a second opening closed by an end region of the perforator, the actuating element being operatively connected to the end region and closing the second opening of the capsule of the perforator, the adapter, the capsule, and the actuating element forming mutually separate components; and an intermediate fitting receiving the capsule and operatively connected to the adapter.

10. The container closure according to claim 9, wherein the intermediate fitting has at least one passage.

* * * * *